US010198929B2

(12) United States Patent
Snyder

(10) Patent No.: US 10,198,929 B2
(45) Date of Patent: Feb. 5, 2019

(54) WATER SAFETY MONITORING SYSTEMS AND RELATED METHODS

(71) Applicant: Seal Innovation, Inc., Raleigh, NC (US)

(72) Inventor: Graham E. Snyder, Raleigh, NC (US)

( * ) Notice: Subject to any disclaimer, the term of this patent is extended or adjusted under 35 U.S.C. 154(b) by 0 days.

(21) Appl. No.: 14/903,726

(22) PCT Filed: Jul. 10, 2014

(86) PCT No.: PCT/US2014/046133
§ 371 (c)(1),
(2) Date: Jan. 8, 2016

(87) PCT Pub. No.: WO2015/006551
PCT Pub. Date: Jan. 15, 2015

(65) Prior Publication Data

US 2016/0155314 A1 Jun. 2, 2016

Related U.S. Application Data

(60) Provisional application No. 61/844,543, filed on Jul. 10, 2013.

(51) Int. Cl.
*G08B 21/08* (2006.01)

(52) U.S. Cl.
CPC ..... *G08B 21/08* (2013.01); *G08B 21/084* (2013.01); *G08B 21/086* (2013.01); *G08B 21/088* (2013.01)

(58) Field of Classification Search
CPC .... G08B 21/08; G08B 21/084; G08B 21/086; G08B 21/088
See application file for complete search history.

(56) References Cited

U.S. PATENT DOCUMENTS 5,486,814 A * 1/1996 Quinones ..... G08B 21/088 340/569
5,587,704 A * 12/1996 Foster ..... G08B 7/06 340/326

(Continued)

FOREIGN PATENT DOCUMENTS

FR 2894702 6/2007
WO WO 2005/015518 2/2005

OTHER PUBLICATIONS

International Preliminary Report on Patentability for PCT/US2014/046133 dated Jan. 21, 2016.

(Continued)

*Primary Examiner* — Patrick Edouard
*Assistant Examiner* — Eboni Hughes
(74) *Attorney, Agent, or Firm* — Myers Bigel, P.A.

(57) ABSTRACT

A system for reducing a risk of drowning in a pool includes a pool monitoring unit and a swim monitoring station. The pool monitoring unit is switchable between an activated state and a deactivated state. The pool monitoring unit is configured to detect entrance into the pool and/or movement in the pool and to output an alarm signal in response a detected entrance into the pool and/or movement in the pool when in the activated state. The swim monitoring station is configured to wirelessly communicate with one or more wearable alarm devices and the swim monitoring station is in wireless communication with the pool monitoring unit. The swim monitoring station is switchable between an off state and an on state. In the on state, the swim monitoring station is configured send a wireless signal to the pool monitoring unit to deactivate the pool monitoring unit.

30 Claims, 8 Drawing Sheets

(56) References Cited

U.S. PATENT DOCUMENTS 7,554,453 B2 * 6/2009 Snyder ..... G08B 21/088 340/309.16
9,595,178 B2 * 3/2017 Snyder ..... G08B 21/088
9,633,547 B2 * 4/2017 Farrand ..... G08B 25/001
9,715,808 B2 * 7/2017 Snyder ..... G08B 21/088
2003/0222782 A1 * 12/2003 Gaudreau ..... G08B 21/082 340/573.6
2005/0012629 A1 * 1/2005 Shebek ..... G08B 5/36 340/679
2006/0017559 A1 * 1/2006 Albert ..... G04G 13/021 340/531
2008/0150733 A1 * 6/2008 Snyder ..... G08B 21/088 340/573.6
2008/0218332 A1 * 9/2008 Lyons ..... G08B 21/088 340/529
2008/0266118 A1 * 10/2008 Pierson ..... A61B 5/0205 340/573.6
2008/0278338 A1 * 11/2008 Krell ..... G08B 21/088 340/573.6
2009/0251323 A1 * 10/2009 Snyder ..... G08B 21/088 340/604
2010/0176956 A1 * 7/2010 Moerschell ..... E04H 4/06 340/573.6
2014/0049394 A1 * 2/2014 Snyder ..... G08B 21/088 340/573.6
2015/0161870 A1 * 6/2015 Podlisker ..... G08B 21/08 340/573.6
2016/0005292 A1 * 1/2016 Carroll ..... G08B 21/088 340/539.13
2016/0042629 A1 * 2/2016 Snyder ..... G08B 21/088 340/573.6
2017/0124841 A1 * 5/2017 Snyder ..... H04B 17/318

OTHER PUBLICATIONS

International Search Report and Written Opinion of the International Search Authority for PCT/US2014/046133 dated Nov. 3, 2014.
Extended European Search Report for EP application No. 14822344.9 dated Mar. 7, 2017, 7 pages.

* cited by examiner

WATER SAFETY MONITORING SYSTEMS AND RELATED METHODS

RELATED APPLICATIONS

The present application is a 35 U.S.C. § 371 national phase application of PCT International Application No. PCT/US2014/046133, filed Jul. 10, 2014, which claims priority to U.S. Provisional Application Ser. No. 61/844,543, filed Jul. 10, 2013, the disclosures of which are hereby incorporated herein by reference in their entirety. PCT International Application No. PCT/US2014/046133 is published in English as PCT Publication No. WO 2015/006551.

BACKGROUND

Drowning remains a significant cause of accidental deaths, especially among children. Many children are non-swimmers and die as a result of falling into swimming pools; however, many children and adults who are swimmers die either from panic, exhaustion, cramps, seizures or a combination thereof. Children may drown despite being supervised while swimming. The parents or other adults supervising the child may have "just looked away for a second" only to find the child drowned on the bottom of the pool.

Several attempts have been made to address water safety with various degrees of success. One approach taken to prevent drowning is to place an alarm on the pool itself. Exemplary pool alarms are Poolguard® Models PGRM-2 and PGRM-SB available from PBM Industries, Inc. (North Vernon, Ind.). With such pool alarms, an audible alert sounds when a sensor detects entrance into the pool (e.g., due to movement of the water). Pool alarms may be useful if the pool is empty, but are not suited for use with a child who is allowed to play in the pool. Furthermore, the alarm is deactivated when swimming is allowed, and there is a risk that the user may forget or neglect to reactivate the alarm after the swimming session.

Monitoring systems that use wearable alarm devices can provide significant enhancements over pool alarms. For example, wearable swim monitors and drowning detection systems may track the swimmer in the water and identify possible drowning events. However, these systems may be limited in the sense that the swimmer or supervisor must proactively attach the wearable alarm device to the swimmer's body; if the device is not attached, the swimmer will not be protected.

SUMMARY

According to some embodiments of the present invention, a system for reducing a risk of drowning in a pool is provided. The system includes a pool monitoring unit and a swim monitoring station. The pool monitoring unit is switchable between an activated state and a deactivated state. The pool monitoring unit is configured to detect entrance into the pool and/or movement in the pool and to output an alarm signal in response a detected entrance into the pool and/or movement in the pool when in the activated state. The swim monitoring station is configured to wirelessly communicate with one or more wearable alarm devices. The swim monitoring station is in wireless communication with the pool monitoring unit. The swim monitoring station is switchable between an off state and an on state. In the on state, the swim monitoring station is configured send a wireless signal to the pool monitoring unit to deactivate the pool monitoring unit.

The swim monitoring station may be configured to receive an input and, in response, switch to the on state. The swim monitoring station may include a user interface configured to receive the input from a user.

In some embodiments, the swim monitoring station is adapted to releasably hold the one or more wearable alarm devices. The swim monitoring station may be in the off state when each wearable alarm device is held by the monitoring station. In some embodiments, each wearable alarm device is configured to releasably connect to a user and, in response, send a connect signal to the swim monitoring station. The swim monitoring station may be configured to switch to the on state when one of the wearable alarm devices is removed from the swim monitoring station and sends the connect signal.

At least one of the pool monitoring unit and the swim monitoring station may be switchable to a safe mode. In some embodiments, in the safe mode, the swim monitoring station is not switchable to the on state and/or the pool monitoring unit is not switchable to the deactivated state.

In some embodiments, each one of the pool monitoring unit and the swim monitoring station is configured to receive a periodic signal from the other one of the pool monitoring unit and the swim monitoring station. The pool monitoring unit may not be switchable to the deactivated state when the periodic signal is not received at one of the pool monitoring unit and the swim monitoring station. The pool monitoring unit may automatically switch to the activated state when the periodic signal is not received at one of the pool monitoring unit and the swim monitoring station.

The system may include at least one camera at the pool. The camera may be configured to capture photographs and/or video. The camera or a controller associated therewith may be configured to send video feed signals and/or multimedia messaging service (MMS) messages to one or more outside devices. The one or more outside devices may include one or more video monitors and/or mobile communication devices.

In some embodiments, the camera or a controller associated therewith is configured to send video signals and/or MMS messages to the one or more outside devices when the pool monitor unit is in the activated state and an entrance into the pool and/or movement in the pool is detected. The camera or a controller associated therewith may be configured to send video signals and/or MMS messages to the one or more outside devices when the swim monitor station is in the on state. The camera or a controller associated therewith may be configured to send video signals and/or MMS messages to the one or more outside devices when the swim monitor station is in the on state and an alarm condition associated with one of the wearable alarm devices is detected.

The system may include at least one light source. The light source may be configured to illuminate the pool area while the camera captures photographs and/or video. The at least one camera and/or at least one light source may be positioned and configured to provide video and/or MMS messages from below a water surface of the pool. In some embodiments, the camera is configured to detect motion or movement around the pool and/or below a water surface of the pool, and the camera or a controller associated therewith is configured to send a signal to activate the pool monitoring unit when motion or movement is detected and then not detected for a predetermined period of time.

In some embodiments, at least one of the pool monitor unit and the swim monitor station is configured to send short message service (SMS) messages to one or more mobile communication devices. The SMS message(s) may be sent when the pool monitor unit is in the activated state and an entrance into the pool and/or movement in the pool is detected. The SMS message(s) may be sent when the swim monitor station is switched to the on state. The SMS message(s) may be sent when the swim monitor station is in the on state and an alarm condition associated with one of the wearable alarm devices is detected.

In some embodiments, at least one of the pool monitor unit and the swim monitor station is configured to autodial one or more telecommunication devices and play a prerecorded message.

In some embodiments, the pool monitor unit is configured to automatically switch to the activated state after the swim monitor station has switched to the on state and a predetermined period of time has elapsed without the swim monitoring station having received a wireless signal from one of the wearable alarm devices.

In some embodiments, the pool monitor unit is configured to detect a level of movement of water in the pool regardless of whether the pool monitor unit is in the activated or deactivated state. The pool monitor unit may be configured to automatically switch from the deactivated state to the activated state after a predetermined period of time has elapsed without detection the level of movement of the water in the pool. In some embodiments, the pool monitor unit is configured to detect a level of movement of water in the pool, and the pool monitor unit is configured to automatically switch to the activated state after the swim monitor station has switched to the on state and a predetermined period of time has elapsed without the swim monitor station having received a wireless signal from at least one of the wearable alarm devices indicating that the at least one wearable alarm devices is moving and/or wet.

According to some other embodiments of the present invention, a water safety monitoring system is provided. The system includes one or more wearable monitoring devices and a pool alarm unit. The pool alarm unit is configured to deactivate when at least one of the wearable monitoring devices is connected to a user.

According to some other embodiments of the present invention, a method includes providing a pool monitoring unit and a swim monitoring system at a swimming pool. The pool monitoring unit is switchable between an activated state and a deactivated state. The swim monitoring system is in wireless communication with the pool monitoring unit. The swim monitoring system is switchable between an on state and an off state. The method includes switching the swim monitoring system to the on state. The method includes automatically switching the pool monitoring unit to the deactivated state in response to switching the swim monitoring system to the on state.

In some embodiments, the method includes sensing for excessive water movement in the swimming pool using the pool monitoring unit. The method may include outputting an alarm signal using the pool monitoring unit when the pool monitoring unit is in the activated state and excessive water movement is sensed. The method may include automatically switching the pool monitoring unit to the activated state when the pool monitoring unit is in the deactivated state and excessive water movement is not sensed over a predetermined length of time.

In some embodiments, the step of switching the pool monitoring unit to the deactivated state in response to switching the swim monitoring system to the on state includes sending a deactivate signal from the swim monitoring system to the pool monitoring unit.

The method may include wirelessly sending an announcement to one or more outside devices using one of the pool monitoring unit and the swim monitoring system.

In some embodiments, the method includes streaming video captured by a camera at the swimming pool to a monitor that is situated away from the swimming pool.

It is noted that any one or more aspects or features described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

BRIEF DESCRIPTION OF THE FIGURES

The accompanying drawings, which are incorporated in and constitute a part of the specification, illustrate embodiments of the invention and, together with the description, serve to explain principles of the invention.

DETAILED DESCRIPTION OF EMBODIMENTS OF THE INVENTION

Figure 1:
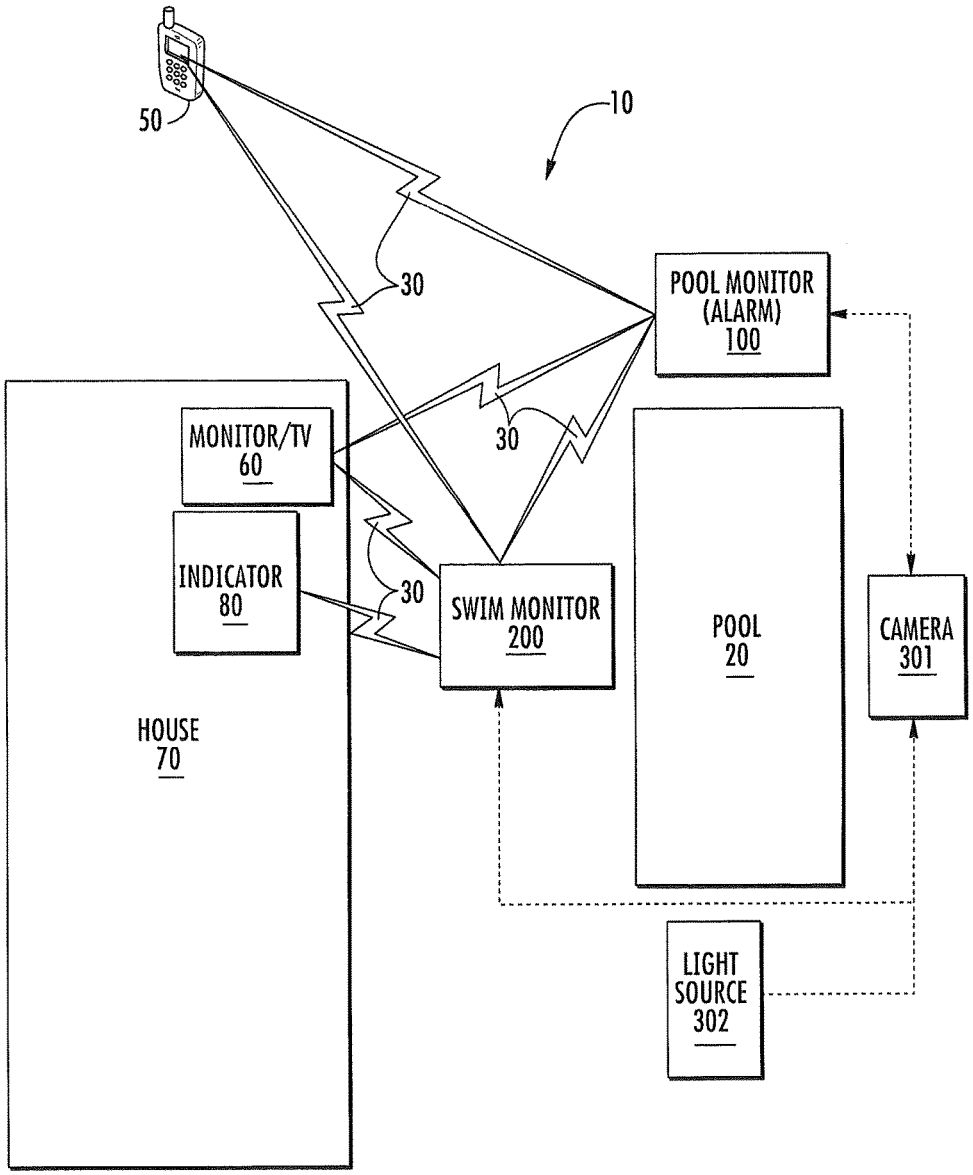
FIG. 1 is a schematic drawing illustrating a pool safety system having a pool monitoring unit and a swim monitoring station according to some embodiments of the present invention.

The present invention now will be described hereinafter with reference to the accompanying drawings and examples, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be understood that when an element is referred to as being "on," "attached" to, "connected" to, "coupled" with, "contacting," etc., another element, it can be directly on, attached to, connected to, coupled with or contacting the other element or intervening elements may also be present. In contrast, when an element is referred to as being, for example, "directly on," "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under," "below," "lower," "over," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of "over" and "under." The device may be otherwise oriented (rotated 90 degrees or at other orientations) and the spatially relative descriptors used herein interpreted accordingly. Similarly, the terms "upwardly," "downwardly," "vertical," "horizontal" and the like are used herein for the purpose of explanation only unless specifically indicated otherwise.

It will be understood that, although the terms "first," "second," etc. may be used herein to describe various elements, these elements should not be limited by these terms. These terms are only used to distinguish one element from another. Thus, a "first" element discussed below could also be termed a "second" element without departing from the teachings of the present invention. The sequence of operations (or steps) is not limited to the order presented in the claims or figures unless specifically indicated otherwise.

Exemplary embodiments are described below with reference to block diagrams and/or flowchart illustrations of computer-implemented methods, apparatus (systems and/or devices) and/or computer program products. It is understood that a block of the block diagrams and/or flowchart illustrations, and combinations of blocks in the block diagrams and/or flowchart illustrations, can be implemented by computer program instructions that are performed by one or more computer circuits. These computer program instructions may be provided to a processor circuit of a general purpose computer circuit, special purpose computer circuit, and/or other programmable data processing circuit to produce a machine, such that the instructions, which execute via the processor of the computer and/or other programmable data processing apparatus, transform and control transistors, values stored in memory locations, and other hardware components within such circuitry to implement the functions/acts specified in the block diagrams and/or flowchart block or blocks.

These computer program instructions may also be stored in a computer-readable memory that can direct a computer or other programmable data processing apparatus to function in a particular manner, such that the instructions stored in the computer-readable memory produce an article of manufacture including instructions which implement the functions/acts specified in the block diagrams and/or flowchart block or blocks.

The computer-usable or computer-readable medium may be, for example but not limited to, an electronic, magnetic, optical, electromagnetic, or semiconductor data storage system, apparatus, or device. More specific examples (a non-exhaustive list) of the computer-readable medium would include the following: a portable computer diskette, a random access memory (RAM) circuit, a read-only memory (ROM) circuit, an erasable programmable read-only memory (EPROM or Flash memory) circuit, a portable compact disc read-only memory (CD-ROM), and a portable digital video disc read-only memory (DVD/BlueRay). It should also be noted that in some alternate implementations, the functions/acts noted in the blocks may occur out of the order noted in the flowcharts. For example, two blocks shown in succession may in fact be executed substantially concurrently or the blocks may sometimes be executed in the reverse order, depending upon the functionality/acts involved. Moreover, the functionality of a given block of the flowcharts and/or block diagrams may be separated into multiple blocks and/or the functionality of two or more blocks of the flowcharts and/or block diagrams may be at least partially integrated.

Generally speaking, embodiments of the present invention integrate a pool monitoring system (e.g., swimming pool alarm) and a swim monitoring system that employs one or more wearable body monitors. The pool monitoring system and swim monitoring system cooperate to provide enhanced pool safety.

A water safety monitoring system 10 for use with a swimming pool 20 is illustrated in FIG. 1. The system 10 includes a pool monitoring device or unit 100 (e.g., a pool alarm) and a swim monitoring device, system or station 200. The pool monitoring unit 100 is switchable between an activated state and a deactivated state. In the activated state, the pool monitoring unit 100 may be configured to detect entrance into the pool 20 and/or movement in the pool 20 and output an alarm signal in response to a detected entrance into the pool 20. In some embodiments, the pool monitoring unit 100 is configured to detect motion and/or movement around the pool 20 and/or in the pool 20 (e.g., underwater motion).

The pool monitoring unit 100 has a wireless communication link 30 with the swim monitoring station 200. The swim monitoring station 200 is switchable between an off state and an on state. When switched to the on state, the swim monitoring station 200 is configured to send a wireless signal to the pool monitoring unit 100 to deactivate the pool monitoring unit 100, as will be described in more detail below.

Figure 2:
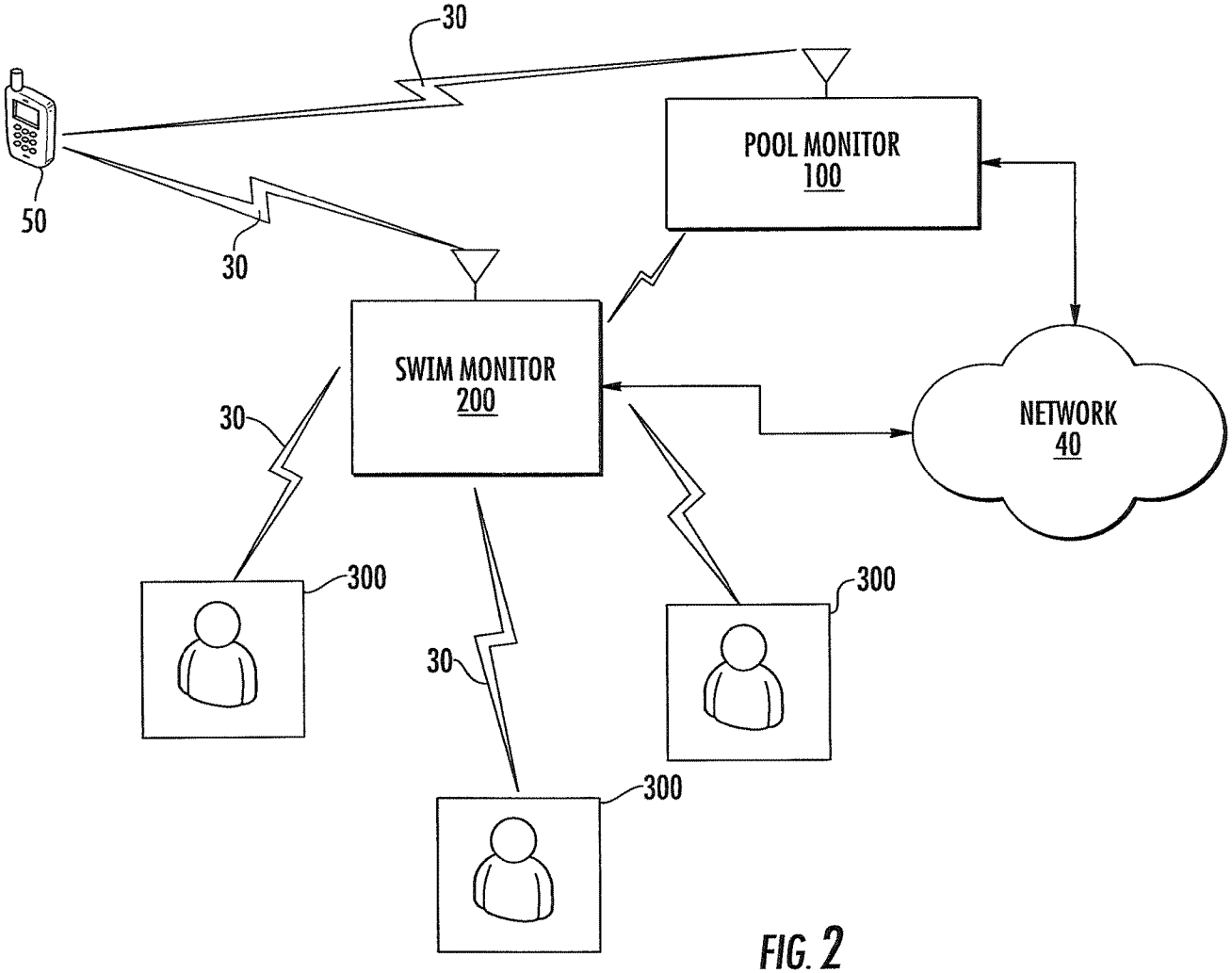
FIG. 2 is a schematic drawing illustrating a pool monitoring unit, a swim monitoring station and a plurality of wearable alarm devices according to some embodiments of the present invention.

As illustrated in FIG. 2, the swim monitoring station 200 has wireless communication links 30 with one or more wearable user alarm devices 300. A water safety monitoring system including the swim monitoring station 200 and the alarm devices 300 is described in detail in co-owned and co-pending U.S. application Ser. No. 13/587,488, filed Aug. 16, 2012, and published as U.S. Patent Application Publication No. 2014/0049394, the disclosure of which is hereby incorporated by reference in its entirety. As described in U.S. application Ser. No. 13/587,488, the swim monitoring station 200 is configured to receive status data from the one or more wearable alarm devices 300 and is configured to detect a triggering event. In response to the triggering event, the swim monitoring station 200 is configured to select an alarm protocol (e.g., a drowning alarm or a concern alarm). The alarm protocol may include visual, audible and/or vibration alarms to alert a lifeguard or other caretaker that one of the alarm devices 300 is indicating an event of serious concern (e.g., a drowning alarm) and/or is indicating an event of perhaps less serious concern (e.g., a concern alarm).

The user alarm device 300 may be configured as a necklace or other wearable device. Suitable alarm device configurations are discussed and illustrated in U.S. application Ser. No. 13/587,488 and Ser. No. 29/460,466 entitled "Monitoring Band" (allowed and pending issuance) as well as co-owned U.S. Pat. No. 7,554,453, the disclosures of which are hereby incorporated by reference in their entireties.

Figure 3:
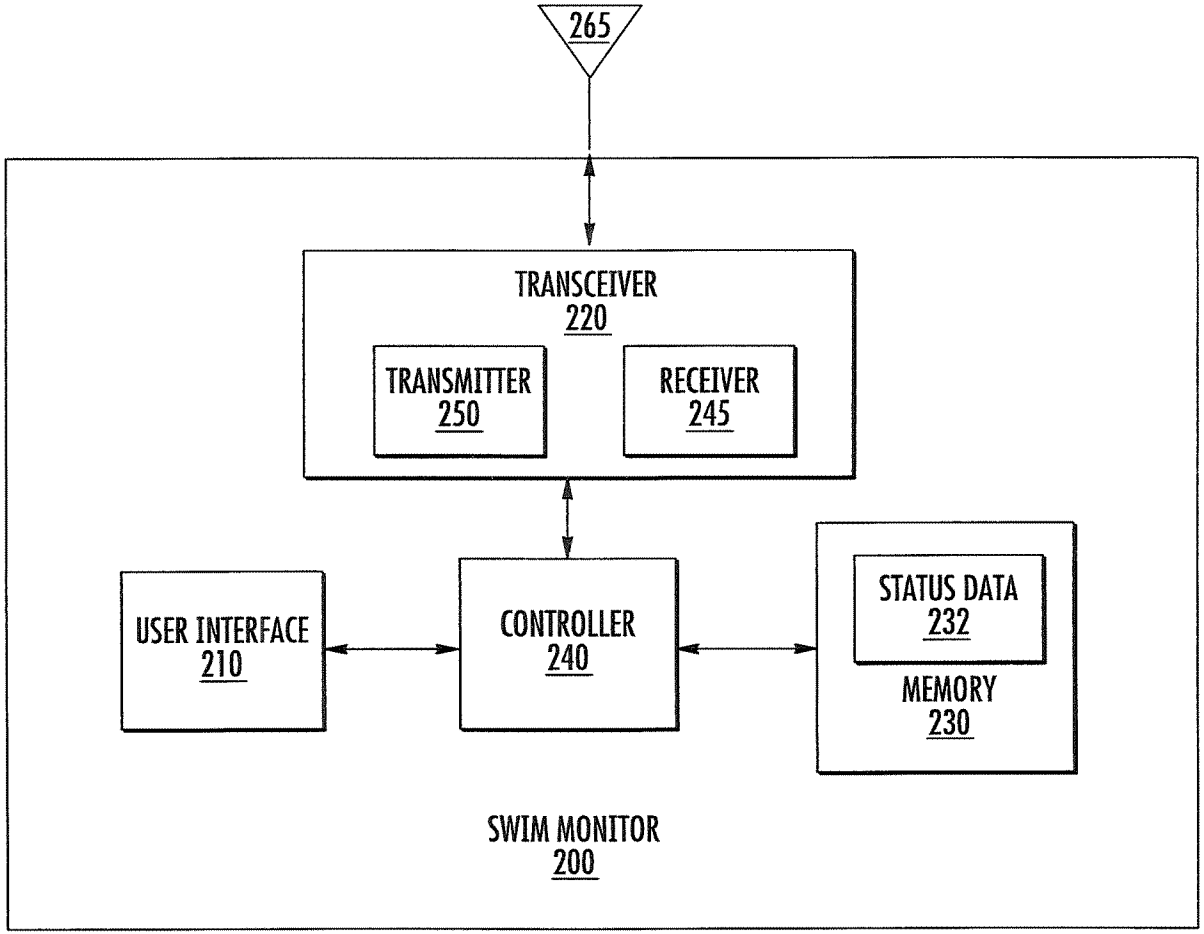
FIG. 3 is a block diagram of a swim monitoring station according to some embodiments of the present invention.

As illustrated in FIG. 3, the swim monitoring station 200 may include a user interface 210, a transceiver 220, a memory 230 and a controller 240. The transceiver 220 may be a wireless transceiver and may include a receiver 245 and a transmitter 250, which may be coupled to an antenna 265. The transceiver 220 is configured to establish a wireless connection, e.g., with the pool monitoring unit 100, the alarm devices 300, the network 40 (FIG. 2) and/or one or more outside devices 50, 60 (FIG. 1).

Figure 8:
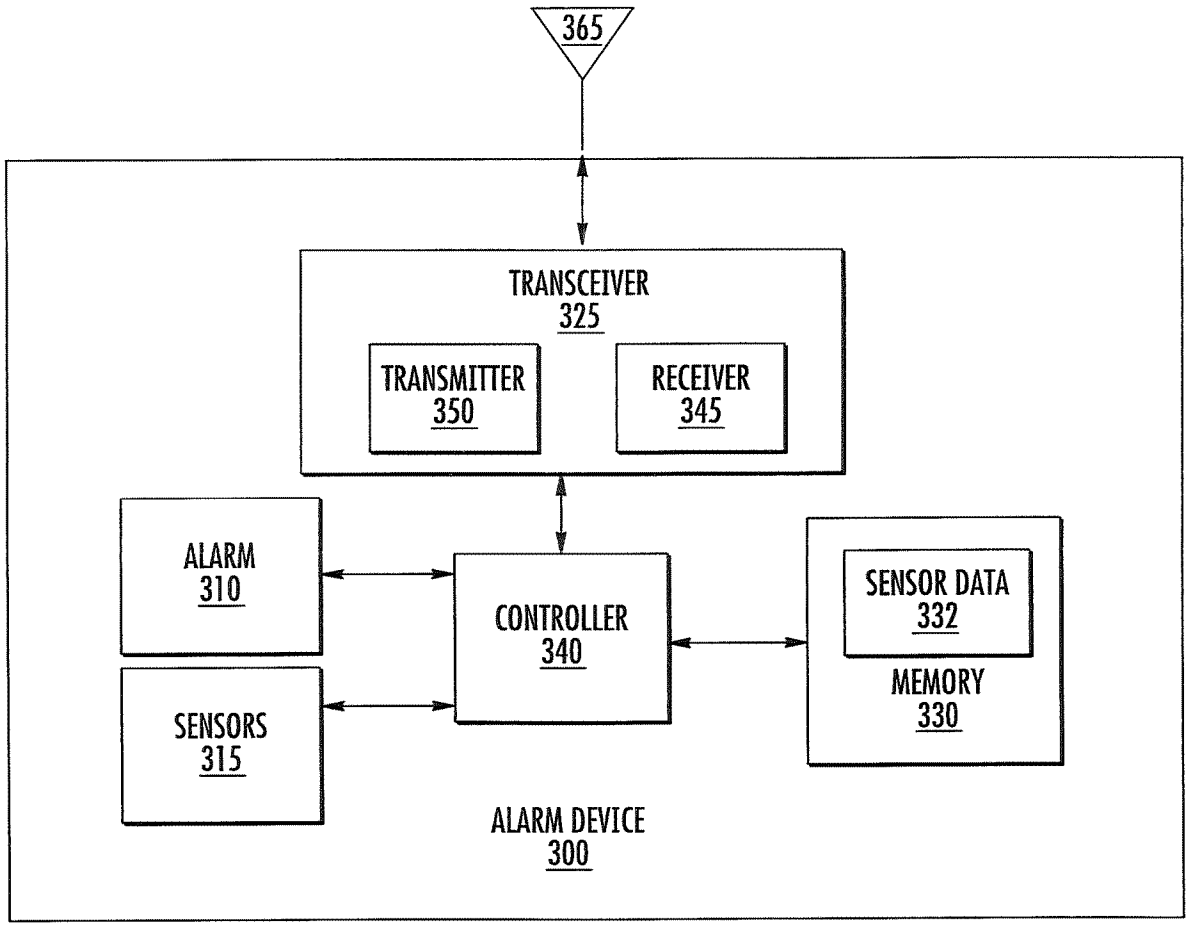
FIG. 8 is a block diagram of a user alarm device according to some embodiments of the present invention.

As illustrated in FIG. 8, the alarm device 300 includes an alarm indicator 310, sensors 315, a transceiver 320, a memory 330 and a controller 340. The transceiver 320 may be a wireless transceiver and may include a receiver 345 and a transmitter 350, which may be coupled to an antenna 365. In some embodiments, the wireless connection between the monitoring station 200 and the alarm devices 300 is a radio frequency (RF) connection; however, any suitable wireless connection may be used, including cellular telephone connections, a Bluetooth® connection, a wireless local area network connection (e.g., 802.11), ultrasonics and the like. In some embodiments, the wireless connection between the swim monitoring station 200 and one or more of the other components (e.g., the pool monitoring unit 100 and/or the outside devices 50, 60) is a radio frequency (RF) connection; however, any suitable wireless connection may be used, including cellular telephone connections, a Bluetooth® connection, a wireless local area network connection (e.g., 802.11), ultrasonics and the like.

As illustrated in FIG. 1, status updates, including data from the sensors 315 and/or position information for the devices 300, may be communicated by the alarm devices 300 to the monitoring station 200 and may be stored as status data 232 in the memory 230. If a triggering event occurs, such as a loss of communication, the monitoring station 200 selects one of a plurality of alarm protocols. The alarm protocol is conveyed to a user, for example, on the user interface 210 illustrated in FIG. 3. The user interface 210 of the monitoring station 200 may be any suitable user interface, such as a touch sensitive screen, a keypad, a joystick or other user interface and may include display features for displaying information (e.g., a display screen or an indicator light for a given alarm level), a speaker for indicating an auditory alarm, and/or a vibration feature for vibrating a mobile alarm 202. Accordingly, the user interface 210 is configured to communicate alarm information through any suitable user interface.

The sensors 315 of the alarm device 300 may include sensors for detected environmental conditions of the alarm device 300. For example, the sensors 315 may include accelerometers, moisture/water sensors, temperature sensors, position sensors, inductive capacitance sensors, ultraviolet radiation sensors, depth gauges and the like for detecting whether the device 300 is wet, dry, moving, or still. In particular embodiments, a charging port may also be configured as a sensor 315 so that when the charging port having two electrical terminals is wet, the corresponding change in conductivity between the charging ports secondary to water and not air bridging the contacts is detected by the device 300. In some embodiments, the sensor 315 may provide data as a state (e.g., wet or dry, moving or still); however, a quantitative value may also be measured by the sensors 315 (e.g., velocity, location, distance from the monitoring device 200, and the like). The memory 330 may include data, such as sensor data 332, including information recorded by the sensors 315 regarding the environmental conditions of the alarm device 300.

Figure 4:
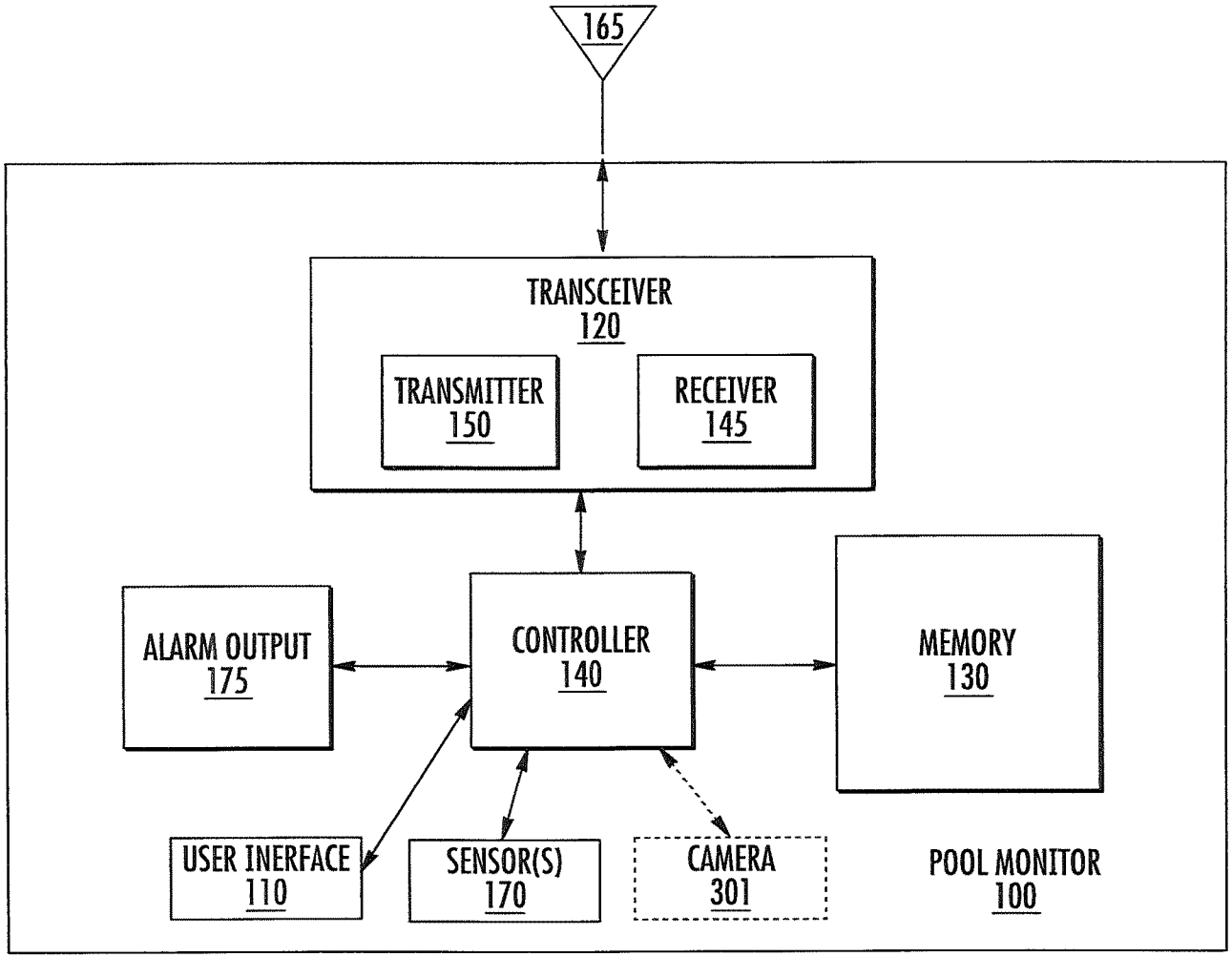
FIG. 4 is a block diagram of a pool monitoring unit according to some embodiments of the present invention.

As illustrated in FIG. 4, the pool monitoring unit 100 may include a user interface 110, a transceiver 120, a memory 130 and a controller 140. The transceiver 120 may be a wireless transceiver and may include a receiver 145 and a transmitter 150, which may be coupled to an antenna 165. The transceiver 120 is configured to establish a wireless connection, e.g., with the swim monitoring station 200, the network 40 (FIG. 2) and/or one or more outside devices 50, 60 (FIG. 1). As noted above, the pool monitoring unit 100 and the swim monitoring station 200 may be configured to communicate data therebetween over a direct wireless communication interface or over another wireless communication interface through another device, such as a cellular base station or wireless local area network (WLAN) router.

The pool monitoring unit 100 includes one or more sensors 170 and one or more alarm output devices 175. At least one sensor 170 may be in communication with or directed toward the water in the swimming pool 20 (FIG. 1) such that the sensor can detect excessive water movement, which may be indicative of an entrance into the swimming pool 20. At least one sensor 170 may be directed toward a perimeter of the swimming pool 20 and/or toward an entrance of the swimming pool 20 to detect movement near the swimming pool 20 by a child or an unauthorized person. In some embodiments, at least one sensor 170 and/or at least one camera 301 may be positioned and configured to detect motion or movement below a water surface of the pool 20, as described in more detail below. Generally speaking, the pool monitoring unit 100 may be configured for wave, motion or sound detection. For example, the pool monitoring unit 100 may detect motion by: infrared (e.g., Passive and active sensors); Optics (e.g., video and camera systems);

Radio Frequency Energy (e.g., radar, microwave and tomographic motion detection); Sound (e.g., using microphones and acoustic sensors); Vibration (e.g., triboelectric, seismic, and inertia-switch sensors); and Magnetism (e.g., magnetic sensors and magnetometers). In response to a detected entrance or movement, the sensor 170 and/or the controller 140 may send an alarm signal to the alarm output device 175, which may output an audible and/or visual alert at the pool monitoring unit 100. Additionally or alternatively, in response to a detected entrance or movement, the transceiver 120 may send an alarm signal or other alert to one or more outside devices, as will be described in greater detail below. The pool monitoring unit 100 will typically only provide alarm signals when in the activated state.

As noted above, when switched to the on state, the swim monitoring station 200 is configured to send a wireless signal to the pool monitoring unit 100 to deactivate the pool monitoring unit 100. For example, the swim monitoring station 200 may switch to the on state when one of the wearable alarm devices 300 is attached or connected to a user. The wearable alarm device 300 may send a connect signal to the swim monitoring station 200, which may in turn send a deactivate signal to the pool monitoring unit 100. Alternatively, the wearable alarm device 300 may be configured to wirelessly communicate with the pool monitoring unit 100 and to send a connect/deactivate signal to the pool monitoring unit 100.

Figure 5:
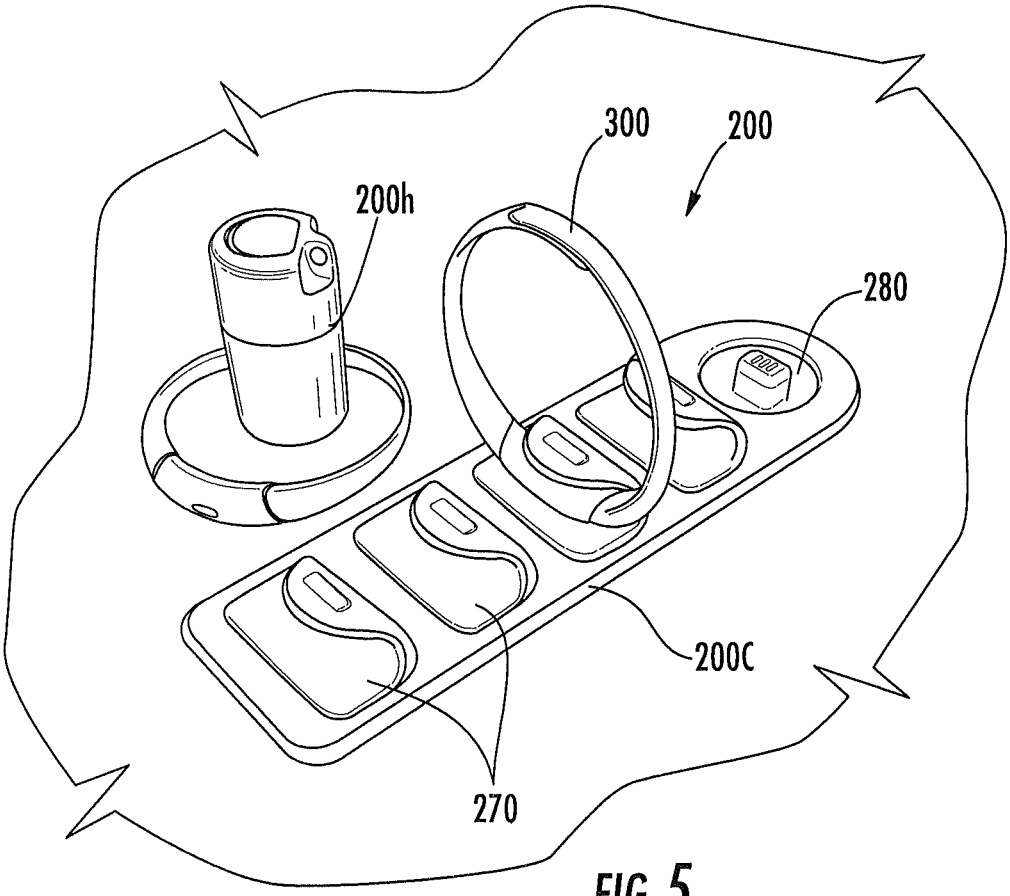
FIG. 5 is an illustration of a pool monitoring station configured to releasably hold a plurality of wearable alarm devices according to some embodiments of the present invention.

In some embodiments, and as illustrated in FIG. 5, the swim monitoring station 200 may include a charging station 200*c* having recharging outlets 270 such that a plurality of user alarm devices 300 may be recharged at the monitoring station 200. Each outlet 270 is configured to releasably hold one of the alarm devices 300, and the swim monitoring station 200 may be configured to detect or sense when one of the alarm devices 300 has been removed from a respective one of the outlets 270. In some embodiments, the swim monitoring station 200 is configured to detect or sense that an alarm device 300 has been removed from one of the outlets 270 and thereafter receive a connect signal from the alarm device 300 indicating that the alarm device 300 has been attached or connected to a user. The swim monitoring station 200 may then switch to the on state and send a deactivate signal to the pool monitoring unit 100.

In some embodiments, and as illustrated in FIG. 5, the charging station 200*c* may include an outlet 280 configured to releasably receive a monitoring hub 200*h*. The hub 200*h* may include at least some of the components illustrated in FIG. 3. Thus, in some embodiments, the hub 200*h* may carry out at least some of the functionality of the swim monitoring station 200 described herein.

The swim monitoring station 200 may be configured to receive an input and, in response, switch to the on state. For example, the input may include sensing that one of the alarm devices 300 has been removed from the charging station 200*c* and/or receiving a connect signal from the wearable alarm device 300 indicating that the alarm device 300 has been attached or connected to a user's body. The user interface 210 of the swim monitoring station 200 may also be configured to receive a user input, with the input necessary to switch the swim monitoring station 200 to the on state. For example, the user interface 210 may include a touch sensitive display or a keypad configured to receive a passcode as the user input. The user interface 210 may also include instrumentation for fingerprint recognition, retinal recognition, voice recognition or the like to recognize authorized users as the user input. Other configurations are contemplated; for example, the user interface 210 may be configured to recognize a magnetic strip from an authorized user card, to recognize an authorized RFID tag and so forth.

In some embodiments, the swim monitoring station 200 may only be turned to the on state after an input is received at the user interface 210 and one of the wearable alarm devices 300 is connected to a user. In some embodiments, the user interface 210 is used to receive input and to allow time for a user to disconnect the wearable alarm device 300 and return it to the charging station 200*c* such that the pool monitoring unit 100 does not reactivate immediately upon the user disconnecting the wearable alarm device 300.

At least one of the pool monitoring unit 100 and the swim monitoring station 200 may be placed in a safe mode. In the safe mode, the pool monitoring unit 100 is not switchable to the deactivated state and/or the swim monitoring station 200 is not switchable to the on state. The user interface of the pool monitoring unit 100 and/or the swim monitoring station 200 may be used to place the pool monitoring unit 100 and/or the swim monitoring station 200 in the safe mode. In some embodiments, the pool monitoring unit 100 and/or the swim monitoring station 200 may receive a signal from the outside device 50 such that the pool monitoring unit 100 and/or the swim monitoring station 200 may be remotely placed in the safe mode.

In some embodiments, one of the pool monitoring unit 100 and the swim monitoring station 200 is configured to receive a continuous or a periodic signal from the other one of the pool monitoring unit 100 and the swim monitoring station 200. If the signal is not received after a predetermined amount of time, the pool monitoring unit 100 may automatically switch to the activated state if in the deactivated state or may be prevented from being switched to the deactivated state if the in activated state. Loss of detection of the continuous or periodic signal may indicate a problem with one of the transceivers, may indicate that the pool monitoring unit 100 and/or the swim monitoring station 200 is low on power, or may indicate some other issue that could compromise safety.

When the swim monitoring station 200 is switched to the on state and the pool monitoring unit 100 is deactivated, the swim monitoring station 200 is configured to monitor the wearable alarm devices 300 and select an alarm protocol in response to a triggering event, as described in U.S. application Ser. No. 13/587,488. In some embodiments, if the swim monitoring station 200 detects a triggering event and selects an alarm protocol, the swim monitoring station 200 may automatically send an activate signal to the pool monitoring unit 100 to thereby activate the pool monitoring unit 100. In this regard, were there to be a drowning or near-drowning event, the pool monitoring unit 100 would detect water motion and/or other movement and output an alarm signal to provide an extra layer of security and/or warning. In some embodiments, the swim monitoring station 200 may send an activate signal when the swim monitoring station 200 selects a drowning alarm indicating a higher risk of drowning, but perhaps not an alarm indicating a lower risk.

In some embodiments, the pool monitoring unit 100 may be configured to automatically switch to the activated state after the swim monitoring station 200 has switched to the on state and a predetermined amount of time has elapsed without the swim monitoring station 200 having received a signal from one of the wearable alarm devices 300.

In some embodiments, if one of the wearable alarm devices 300 that was previously connected to a user becomes disconnected, the wearable alarm device 300 may send a disconnect signal to the swim monitoring station 200.

In response, the swim monitoring station 200 may send an activate signal to the pool monitoring unit 100. In some embodiments, upon disconnection of the wearable alarm device 300, the wearable alarm device 300 may directly send an activate signal to the pool monitoring unit 100.

As described above, the pool monitoring unit 100 may be configured to detect or sense movement of the pool water, for example movement beyond a threshold level. In some embodiments, the pool monitoring unit 100 is configured to detect or sense movement of the pool water regardless of whether the pool monitoring unit 100 is in the activated or deactivated state. The pool monitoring unit 100 may be configured to automatically switch from the deactivated state to the activated state after a predetermined period of time has elapsed without detection of significant movement of water (e.g., movement beyond a threshold level). This arrangement may allow for the pool monitoring unit 100 to automatically activate if, for example, the user forgot or neglected to activate pool monitoring unit 100 after a swimming session or if some other fault occurred.

In some embodiments, if the pool monitoring unit 100 detects or senses movement of the pool water while in the deactivated state but the swim monitoring station 200 does not receive a signal that one or more of the alarm devices 300 is moving and/or wet (e.g., for a threshold period of time), the pool monitoring unit 100 is configured to automatically switch from the deactivated state to the activated state (e.g., responsive to a signal from the swim monitoring station 200 that the one or more alarm devices 300 is not moving and/or wet). This arrangement may allow for the pool monitoring unit 100 to automatically activate if, for example, the user is in the pool but he or she is not wearing an alarm device 300, the user removes the alarm device 300 and/or the monitoring station 200 or the alarm device 300 has malfunctioned.

In some embodiments, upon disconnection of the wearable alarm device 300, the user or a supervisor may have a predetermined amount of time (e.g., 10 seconds) to perform a subsequent act to prevent the pool monitoring unit 100 from being activated right away. The act may include placing the wearable device 300 in the charging station 200*c*. The act may include "closing" the wearable device 300 such that it mimics the configuration when attached to a user. For example, the wearable device may have a latching mechanism that allows it to be connected around the user's neck. The user may unlatch the mechanism to disconnect the device 300 from his or her body and then latch the mechanism. The act may include a user input at the swim monitoring station 200 or the pool monitoring unit 100, for example the user inputs performed at the user interface 210 described above in reference to switching the swim monitoring station 200 to the on state. Other acts are contemplated, including a combination of one or more of the acts just described.

Further, it may be desirable to provide a time delay before the pool monitoring unit 100 is "fully" reactivated after the wearable device 300 is disconnected from the user and/or the subsequent act is performed. There may be substantial movement of water in the swimming pool immediately after a swimming session. The delay before reactivation or full reactivation of the pool monitoring unit 100 may reduce the chance of the pool monitoring unit 100 outputting an alarm signal due to the water movement even though no one is in danger in the pool (i.e., the time delay may allow the water to calm before the pool monitoring unit 100 is reactivated). The time delay may be a predetermined amount of time (e.g., 5 minutes) and may be user adjustable, for example via the user interface 110 and/or 210.

It is contemplated that the pool monitoring unit 100 may have a varying sensitivity to water movement beginning immediately after the wearable alarm device 300 is disconnected from the user and/or the subsequent act is performed. For example, immediately after the wearable alarm device 300 is disconnected from the user and/or the subsequent act is performed, the pool monitoring unit may tolerate relatively substantial water movement without outputting an alarm signal, and the tolerance for water movement may decay over time. This may allow for the pool monitoring unit 100 to be reactivated immediately, but also account for the water movement that will decrease over time after a swimming session. In some embodiments, motion or movement is detected around or in the pool (e.g., underwater) by the pool monitoring unit 100. In such embodiments, it may not be necessary to provide a time delay before reactivating the pool monitoring unit 100.

As noted above, the pool monitoring unit 100 and/or the swim monitoring station 200 may wirelessly communicate with one or more outside devices. As illustrated in FIGS. 1 and 2, the one or more outside devices may include one or more portable electronic devices 50 such as cellular telephones, smartphones, tablet computers and the like. The pool monitoring unit 100 and/or the swim monitoring station 200 may send an announcement to the devices 50 when certain events occur.

An informational announcement may be sent when the pool monitoring unit 100 has been deactivated. For example, the pool monitoring unit 100 and/or the swim monitoring station 200 may be configured to send a short message service (SMS) message or the like to the devices 50 stating something along the lines of "Pool alarm deactivated but all is safe." The pool monitoring unit 100 and/or the swim monitoring station 200 may send periodic informational announcements such as "Swim monitoring system is active and all is safe."

An alert announcement may be sent when a more concerning event has occurred. For example, if the pool monitoring unit 100 outputs an alarm signal, the pool monitoring unit 100 and/or the swim monitoring station 200 may be configured to send a message to the devices 50 stating something like "Pool alarm signal detected!" If the swim monitoring station 200 detects a triggering event and selects an alarm protocol the pool monitoring unit 100 and/or the swim monitoring station 200 may be configured to send a message to the devices 50 stating something along the lines of "Swimmer in trouble!"

The pool monitoring unit 100 and/or the swim monitoring station 200 may also be configured to "autodial" the outside devices 50 and provide a similar prerecorded message instead of or in addition to the text message. The pool monitoring unit 100 and/or the swim monitoring station 200 may also be configured to autodial various other parties to provide the alert announcement. The other parties may include neighbors, 911, EMS, the fire department, home alarm monitoring company and so forth. As such, the alert announcement to the outside devices 50 may state something along the lines of "Pool alarm signal detected! Your neighbor and emergency personnel have been contacted" or "Swimmer in trouble! Your neighbor and emergency personnel have been contacted."

One or more cameras 301 may also be provided at or near the swimming pool 20. In some embodiments, and as shown in FIG. 1, the camera 301 may be a separate component. In this configuration, the camera 301 may capture photographs and/or video and the camera 301 or a controller associated therewith may communicate the photographs and/or video (or data associated therewith) to the pool monitoring unit 100 and/or the swim monitoring station 200 (e.g., via a wired connection or wirelessly). The pool monitoring unit 100 and/or the swim monitoring station 200 may in turn provide the photographs and/or video to the outside devices 50, 60. Alternatively, the camera 301 may be configured to wirelessly communicate the photographs and/or video to the outside devices 50, 60 (e.g., the camera may include a controller and a transmitter). In some embodiments, and as illustrated in FIG. 4, the camera 301 may be included as part of the pool monitoring unit 100, and the transceiver 120 may be configured to transmit the photographs and/or video captured by the camera 301.

The camera 301 may be used for a variety of purposes. For example, the camera 301 may be configured to take photographs that may be sent to the outside devices 50 and/or the other parties as part of the announcements described above. The camera 301 or controller associated therewith may be configured to generate multimedia messaging service (MMS) messages or the like that may be used to provide a snapshot of the pool area along with the associated announcement. At least one camera 301 may be positioned and configured to detect motion or movement under a water surface of the pool. In this regard, the camera(s) may detect underwater motion or movement for the pool monitoring unit 100.

Referring to FIG. 1, the camera 301 may also be used to provide video signals to one or more monitors or televisions 60 that may be positioned inside and/or outside of home 70. For example, the devices 60 may display video of the pool area at all times or when the swim monitor station 200 is in the on state during a swimming session. This arrangement may allow for children playing in the pool to always be in sight of caregivers (e.g., when the parents are going in and out of the house).

One or more light sources 302 (e.g., LED(s), light bulb(s) or other light sources) may be provided for nighttime photographs and/or video captured by the camera 301. The light source 302 may be integrated with the camera 301 or otherwise be in communication with the camera 301. In some embodiments, the camera 301 and the light source 302 are included as part of the pool monitoring unit 100. In some embodiments, when the pool monitoring unit 100 is in the activated state, the light source(s) 302 is always on to provide lighting for the camera(s) 301 or other sensor(s) 170 to detect underwater motion or movement.

At least one camera 301 and/or light source 302 may be positioned and configured such that photographs and/or video may be captured underwater (i.e., beneath the water surface of the pool). The least one camera 301 and/or light source 302 may be always on or may be on when the pool monitoring unit 100 is in the activated state.

The camera 301 may be configured to detect motion or movement around the pool and/or underwater. In some embodiments, the pool monitoring unit 100 may be configured to switch from the deactivated state to the activated state if motion or movement stops or is not detected for a threshold period of time. For example, the pool monitoring unit 100 may switch from the deactivated state to the activated state responsive to a signal from the camera 301 or a controller associated therewith that motion or movement has stopped or has not been detected for a threshold period of time.

Figure 6:
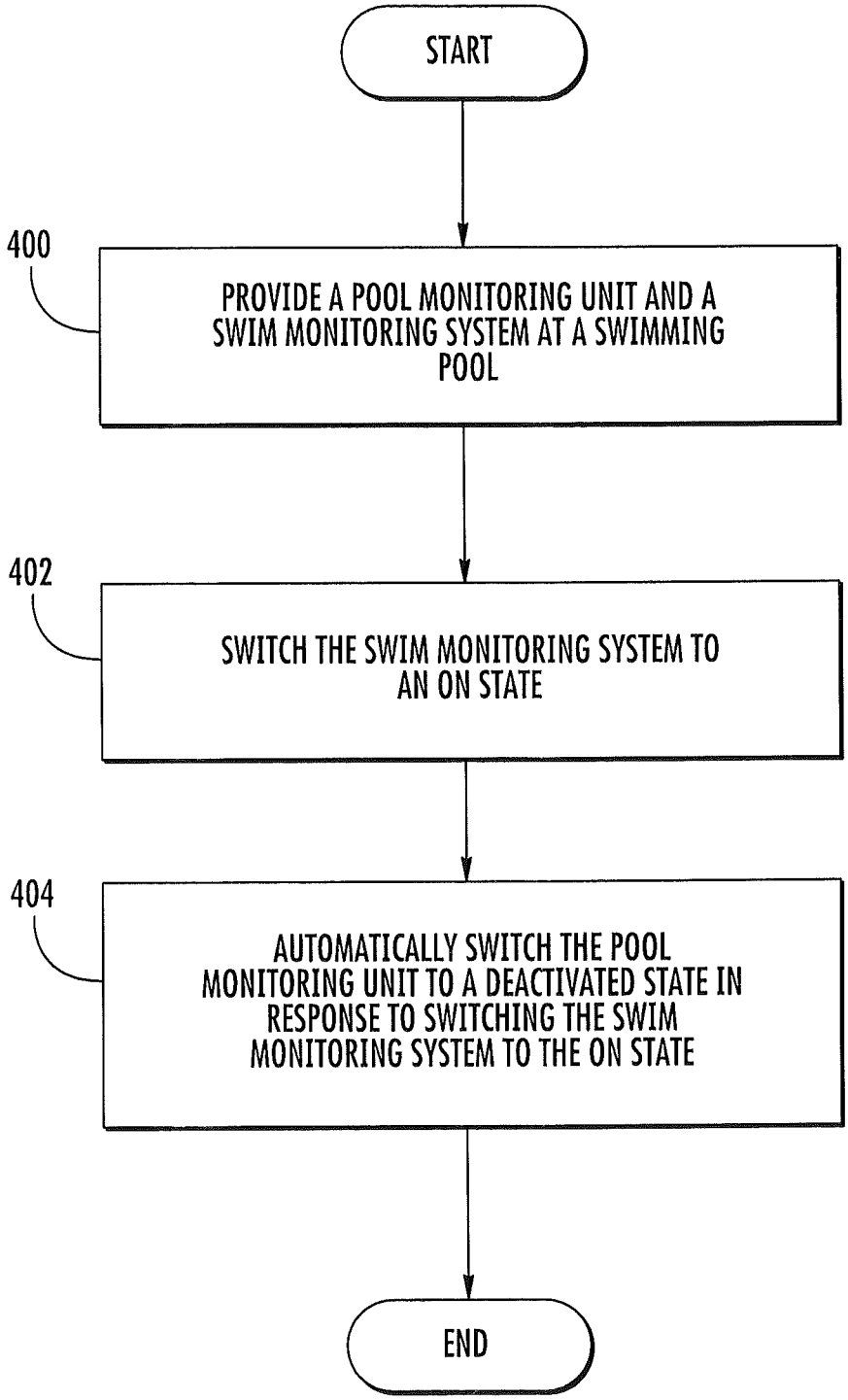
FIGS. 6 and 7 are flowcharts illustrating operations according to some embodiments of the present invention.
Figure 7:
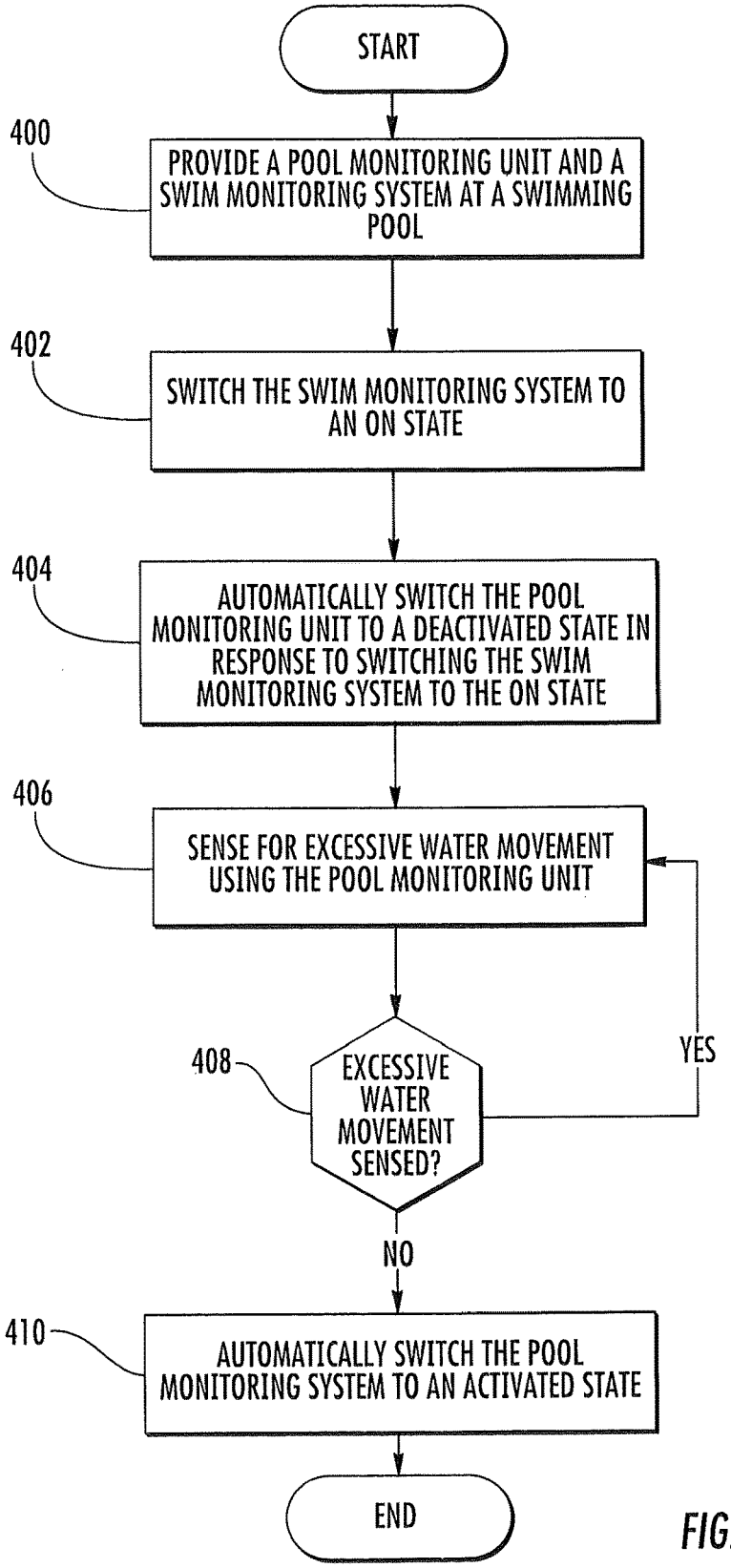

FIGS. 6 and 7 illustrate exemplary operations for enhanced water safety according to embodiments of the invention. Referring to FIG. 6, the pool monitoring unit 100 and the swim monitoring system 200 are provided at a swimming pool (Block 400). The swim monitoring system 200 is switched to the on state (Block 402). The pool monitoring unit 100 automatically switches to the deactivated state in response to the swim monitoring system being switched to the on state (Block 404).

Referring to FIG. 7, the steps corresponding to Blocks 400, 402 and 404 are included. The illustrated operation includes a further step of sensing for excessive water movement (e.g., movement past a certain threshold level) using the pool monitoring unit 100 while the pool monitoring unit 100 is in the deactivated state (Block 406). If excessive movement is not sensed (Block 408), then the pool monitoring unit 100 automatically switches to the activated state (Block 410).

One or more indicator devices 80 may be provided in the house 70. The indicator devices 80 may provide audible and/or visual alerts or indications when a certain event has occurred regarding the pool monitoring unit 100 and/or the swim monitoring station 200. For example, the indicator device(s) 80 may illuminate and/or output an alarm when an alarm condition is detected from the pool monitoring unit 100 and/or the swim monitoring station 200. The indicator device(s) 80 may wirelessly communicate with the pool monitoring unit 100 and/or the swim monitoring station 200 in the same way as described above in connection with the outside devices 50, 60.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A method comprising:

providing the following at a swimming pool:

a pool alarm that is switchable between an activated state and a deactivated state, the pool alarm configured to detect entrance into the pool and/or movement in the pool and to output an alarm signal in response to a detected entrance into the pool and/or movement in the pool when in the activated state;

one or more wearable alarm devices; and a swim monitoring system in wireless communication with the one or more wearable alarm devices and with the pool alarm, the swim monitoring system being switchable between an on state and an off state;

switching the swim monitoring system from the off state to the on state;

automatically switching the pool alarm from the activated state to the deactivated state in response to switching the swim monitoring system from the off state to the on state by sending a wireless signal from the swim monitoring system to the pool alarm;

detecting a triggering event associated with the one or more wearable alarm devices; and automatically switching the pool alarm from the deactivated state to the activated state in response to detecting the triggering event by sending a wireless signal from the swim monitoring system to the pool alarm.

2. The method of claim 1, comprising:

sensing for excessive water movement in the swimming pool using the pool alarm; and outputting an alarm signal using the pool alarm when the pool alarm is in the activated state and excessive water movement is sensed.

3. The method of claim 1, comprising:

sensing for excessive water movement in the swimming pool using the pool alarm; and automatically switching the pool alarm from the deactivated state to the activated state when the pool alarm is in the deactivated state and excessive water movement is not sensed over a predetermined length of time.

4. A system for reducing a risk of drowning in a pool, the system comprising:

a pool alarm, the pool alarm switchable between an activated state and a deactivated state, the pool alarm configured to detect entrance into the pool and/or movement in the pool and to output an alarm signal in response to a detected entrance into the pool and/or movement in the pool when in the activated state;

one or more wearable alarm devices; and a swim monitoring station configured to wirelessly communicate with the one or more wearable alarm devices, the swim monitoring station in wireless communication with the pool alarm, the swim monitoring station switchable between an off state and an on state;

wherein:

when the swim monitoring station is switched from the off state to the on state, the swim monitoring station is configured to send a wireless signal to the pool alarm to automatically switch the pool alarm from the activated state to the deactivated state; and when the swim monitoring station is in the on state and detects a triggering event associated with the one or more wearable alarm devices, the swim monitoring station is configured to send a wireless signal to the pool alarm to automatically switch the pool alarm from the deactivated state to the activated state.

5. The system of claim 4, wherein the swim monitoring station is configured to receive an input and, in response, switch from the off state to the on state.

6. The system of claim 5, wherein the swim monitoring station comprises a user interface configured to receive the input from a user.

7. The system of claim 4, wherein the swim monitoring station is adapted to releasably hold the one or more wearable alarm devices.

8. The system of claim 7, wherein the swim monitoring station is in the off state when each wearable alarm device is held by the monitoring station.

9. The system of claim 7, wherein:

each wearable alarm device is configured to send a connect signal to the swim monitoring station; and the swim monitoring station is configured to switch from the off state to the on state when one of the wearable alarm devices is removed from the swim monitoring station and sends the connect signal.

10. The system of claim 4, wherein at least one of the pool alarm and the swim monitoring station is switchable to a safe mode, wherein, in the safe mode, the swim monitoring station is not switchable from the off state to the on state and/or the pool alarm is not switchable from the activated state to the deactivated state.

11. The system of claim 4, wherein:

each one of the pool alarm and the swim monitoring station is configured to receive a periodic signal from the other one of the pool alarm and the swim monitoring station; and the pool alarm is not switchable from the activated state to the deactivated state when the periodic signal is not received at one of the pool alarm and the swim monitoring station.

12. The system of claim 11, wherein the pool alarm automatically switches from the deactivated state to the activated state when the periodic signal is not received at one of the pool alarm and the swim monitoring station after a predetermined period of time.

13. The system of claim 4, further comprising at least one camera at the pool.

14. The system of claim 13, wherein the camera is configured to capture photographs and/or video, and wherein the camera or a controller associated therewith is configured to send video feed signals and/or multimedia messaging service (MMS) messages to one or more outside devices.

15. The system of claim 14, wherein the one or more outside devices include one or more video monitors and/or mobile communication devices.

16. The system of claim 14, wherein the camera or a controller associated therewith is configured to send video signals and/or MMS messages to the one or more outside devices when the pool alarm is in the activated state and an entrance into the pool and/or movement in the pool is detected.

17. The system of claim 14, wherein the camera or a controller associated therewith is configured to send video signals and/or MMS messages to the one or more outside devices when the swim monitoring station is in the on state.

18. The system of claim 14, wherein the camera or a controller associated therewith is configured to send video signals and/or MMS messages to the one or more outside devices when the swim monitoring station is in the on state and an alarm condition associated with one of the wearable alarm devices is detected.

19. The system of claim 13, further comprising at least one light source, the light source configured to illuminate the pool area while the camera captures photographs and/or video.

20. The system of claim 19, wherein at least one camera and/or at least one light source is positioned and configured to provide video and/or MMS messages from below a water surface of the pool.

21. The system of claim 13, wherein the camera is configured to detect motion or movement around the pool and/or below a water surface of the pool, and wherein the camera or a controller associated therewith is configured to send a signal to activate the pool alarm when motion or movement is detected and then not detected for a predetermined period of time.

22. The system of claim 4, wherein at least one of the pool alarm and the swim monitoring station is configured to send short message service (SMS) messages to one or more mobile communication devices.

23. The system of claim 22, wherein the SMS message(s) are sent when the pool alarm is in the activated state and an entrance into the pool and/or movement in the pool is detected.

24. The system of claim 22, wherein the SMS message(s) are sent when the swim monitoring station is switched to the on state.

25. The system of claim 22, wherein the SMS message(s) are sent when the swim monitoring station is in the on state and an alarm condition associated with one of the wearable alarm devices is detected.

26. The system of claim 4, wherein at least one of the pool alarm and the swim monitoring station is configured to autodial one or more telecommunication devices and play a prerecorded message.

27. The system of claim 4, wherein the pool alarm is configured to automatically switch from the deactivated state to the activated state when the swim monitoring station is in the on state and a predetermined period of time has elapsed without the swim monitoring station having received a wireless signal from at least one of the one or more wearable alarm devices.

28. The system of claim 4, wherein the pool alarm is configured to detect a level of movement of water in the pool, and wherein the pool alarm is configured to automatically switch from the deactivated state to the activated state when the swim monitoring station is in the on state and a predetermined period of time has elapsed without the swim monitoring station having received a wireless signal from at least one of the one or more wearable alarm devices indicating that the at least one wearable alarm device is moving and/or wet.

29. The system of claim 4, wherein the pool alarm is configured to detect a level of movement of water in the pool regardless of whether the pool alarm is in the activated or deactivated state, and wherein the pool alarm is configured to automatically switch from the deactivated state to the activated state after a predetermined period of time has elapsed without detection of the level of movement of the water in the pool.

30. The system of claim 4, wherein the pool alarm comprises at least one sensor directed toward a perimeter of the pool and/or toward an entrance of the pool.

* * * * *